US006948436B2

(12) United States Patent
Mooney et al.

(10) Patent No.: US 6,948,436 B2
(45) Date of Patent: Sep. 27, 2005

(54) METHOD AND APPARATUS FOR THE GASIFICATION AND COMBUSTION OF ANIMAL WASTE, HUMAN WASTE, AND/OR BIOMASS USING A MOVING GRATE OVER A STATIONARY PERFORATED PLATE IN A CONFIGURED CHAMBER

(75) Inventors: Robert Mooney, Roswell, GA (US); David Mooney, Marietta, GA (US); Douglas Latulippe, Alpharetta, GA (US)

(73) Assignee: rem Engineereing, Inc., Roswell, GA (US)

( * ) Notice: Subject to any disclaimer, the term of this patent is extended or adjusted under 35 U.S.C. 154(b) by 19 days.

(21) Appl. No.: 10/704,727

(22) Filed: Nov. 10, 2003

(65) Prior Publication Data

US 2005/0098072 A1 May 12, 2005

(51) Int. Cl.[7] ..... F23H 11/10; F23B 5/00; F23K 3/08; F23J 1/00

(52) U.S. Cl. ..... 110/270; 110/235; 110/268; 110/165 R; 110/248; 110/259

(58) Field of Search ..... 110/269, 270, 110/271, 272, 224, 278, 279, 227, 228, 165 R, 346, 101 R, 234, 235, 268, 248, 259

(56) References Cited

U.S. PATENT DOCUMENTS 1,918,535 A * 7/1933 Greenawalt ..... 110/346
2,267,932 A 12/1941 Lloyd (Continued)

FOREIGN PATENT DOCUMENTS

EP 0 519 178 A1 5/1978
EP 0 762 052 A1 3/1997
GB 388 074 A 2/1933

OTHER PUBLICATIONS

GB 08324 A.A.D. 1915 (Societe Anonyme: Founderies Et Ateliers DeLa Courneuve Oct. 14, 1915.

*Primary Examiner*—Kenneth Rinehart
(74) *Attorney, Agent, or Firm*—Volpe and Koenig, P.C.

(57) ABSTRACT

An apparatus for the combustion of organic waste such as poultry litter/manure, cow manure and swine manure, and/or human waste, and/or biomass using a moving grate over a stationary perforated plate to convert organic waste into usable energy. The unprocessed fuel is fed into the combustion chamber through a feed hopper by a moving grate being continuously pulled over a stationary perforated plate. The raw fuel is metered using a guillotine gate apparatus to control the depth of the fuel bed on the moving grate. Temperature controlled combustion air is directed under the stationary perforated plate (under fire air) into discreet controllable under fire air zones to initiate and drive the combustion process. The stationary plate is sectioned to match the discreet under fire air zones with holes and/or slots (perforations) shaped and sized for proper under fire air distribution and pressure drop through the plate. The under fire air is forced through the stationary perforated plate up through the moving grate into the moving bed of fuel. Additional temperature controlled combustion air is directed above the fuel bed to the over fire air nozzles positioned at strategic locations in the combustion chamber for complete combustion and emission control. The moving grate continues to pull the combusted fuel (ash) out of the combustion chamber and deposits it into an ash collection chamber equipped with automatic ash removal system. A conventional heat recovery unit (i.e. boiler, air heater or similar) placed over the combustion chamber converts the heat from the combustion process into a usable product. A boiler produces steam for process purposes and/or to generate electricity.

28 Claims, 3 Drawing Sheets

U.S. PATENT DOCUMENTS 3,311,090 A 3/1967 Lee
3,963,426 A 6/1976 Hand
3,993,458 A 11/1976 Antal, Jr.
4,077,847 A 3/1978 Choi et al.
4,091,748 A 5/1978 Mansfield
4,231,304 A 11/1980 Hoskinson
4,233,024 A * 11/1980 Plass ..... 432/72
4,308,034 A * 12/1981 Hoang ..... 48/111
4,359,006 A 11/1982 Have
4,385,567 A * 5/1983 Voss ..... 110/186
4,385,905 A 5/1983 Tucker
4,389,288 A 6/1983 Vaughan
4,446,800 A * 5/1984 Lovgren ..... 110/270
4,454,828 A 6/1984 Zempel
4,469,557 A * 9/1984 Schweer et al. ..... 201/17
4,471,702 A 9/1984 McKinlay
4,483,258 A * 11/1984 John et al. ..... 110/235
4,497,637 A 2/1985 Purdy et al.
4,638,629 A 1/1987 Archer et al.
4,676,177 A 6/1987 Engstrom
4,716,843 A 1/1988 Coerper, Jr. et al.
4,747,356 A 5/1988 Beisswenger et al.
4,765,256 A * 8/1988 Caughey ..... 110/229
4,925,540 A 5/1990 Dhooge
5,028,241 A 7/1991 Kooiman et al.
5,047,224 A 9/1991 Dhooge
5,078,593 A * 1/1992 Schreiber et al. ..... 432/103
5,167,372 A 12/1992 Poggie et al.
5,581,998 A 12/1996 Craig
5,715,764 A 2/1998 Lyngfelt et al.
5,724,751 A 3/1998 Ellingsen
6,112,677 A 9/2000 Kuntschar et al.
6,135,035 A 10/2000 Masek
6,149,694 A 11/2000 Redden, Jr. et al.
6,189,463 B1 2/2001 Ling et al.
6,190,566 B1 2/2001 Kolber
6,244,196 B1 6/2001 Kimberlin
6,367,395 B1 4/2002 Masek
6,381,963 B1 5/2002 Graham
6,382,112 B1 * 5/2002 Forsberg et al. ..... 110/342
6,497,741 B2 12/2002 Sower
6,506,223 B2 1/2003 White

* cited by examiner

METHOD AND APPARATUS FOR THE GASIFICATION AND COMBUSTION OF ANIMAL WASTE, HUMAN WASTE, AND/OR BIOMASS USING A MOVING GRATE OVER A STATIONARY PERFORATED PLATE IN A CONFIGURED CHAMBER

BACKGROUND

The preferred current method for disposing of organic waste like animal manure, poultry litter, and even agricultural biomass is land application as natural fertilizer. Environmental legislation in many areas of the United States prohibits or severely limits the use of raw manure and poultry litter as a fertilizer due to concerns about soil nutrient loading levels. Excessive amounts of phosphorous applied to the soil results in the over fertilization (pollution) of our nation's waterways causing ecological and environmental damage. Thus, the quantity of raw manure and litter that cannot be land applied locally due to over-fertilization is being hauled to non-contaminated areas for land application. The practice of hauling the waste product to areas beyond the "contaminated area" results in expensive freight charges and the expansion of the "contaminated area". The production of manure and litter will continue to increase with the growth of the Beef, Pork and Poultry industries. Another method of animal waste disposal is desperately needed.

SUMMARY

This method and apparatus is designed to address the above problems by burning the organic waste material in a clean and efficient manner and using the ash by-product as fertilizer, feed additive, or mineral supplement.

An apparatus for converting organic waste fuel into energy comprises a waste loading area for loading waste onto a moving grate that moves the waste product through the apparatus from the waste loading area to an unloading area; a level control device for controlling the amount of waste that moves from the loading area to the moving grate; a perforated stationary plate located beneath the moving grate with the waste thereon that allows air to pass through perforations to the waste on the moving grate; at least one controlled combustion air zone that directs air with a substantially controlled temperature through the stationary plate to the waste on the moving grate; at least one nozzle that directs air to the waste on the moving grate; and an igniter that reacts with the waste on the moving grate and the air to combust the waste and create at least one waste-byproduct.

BRIEF DESCRIPTION OF THE DRAWING(S)

DETAILED DESCRIPTION OF THE PREFERRED EMBODIMENT(S)

Figure 1:
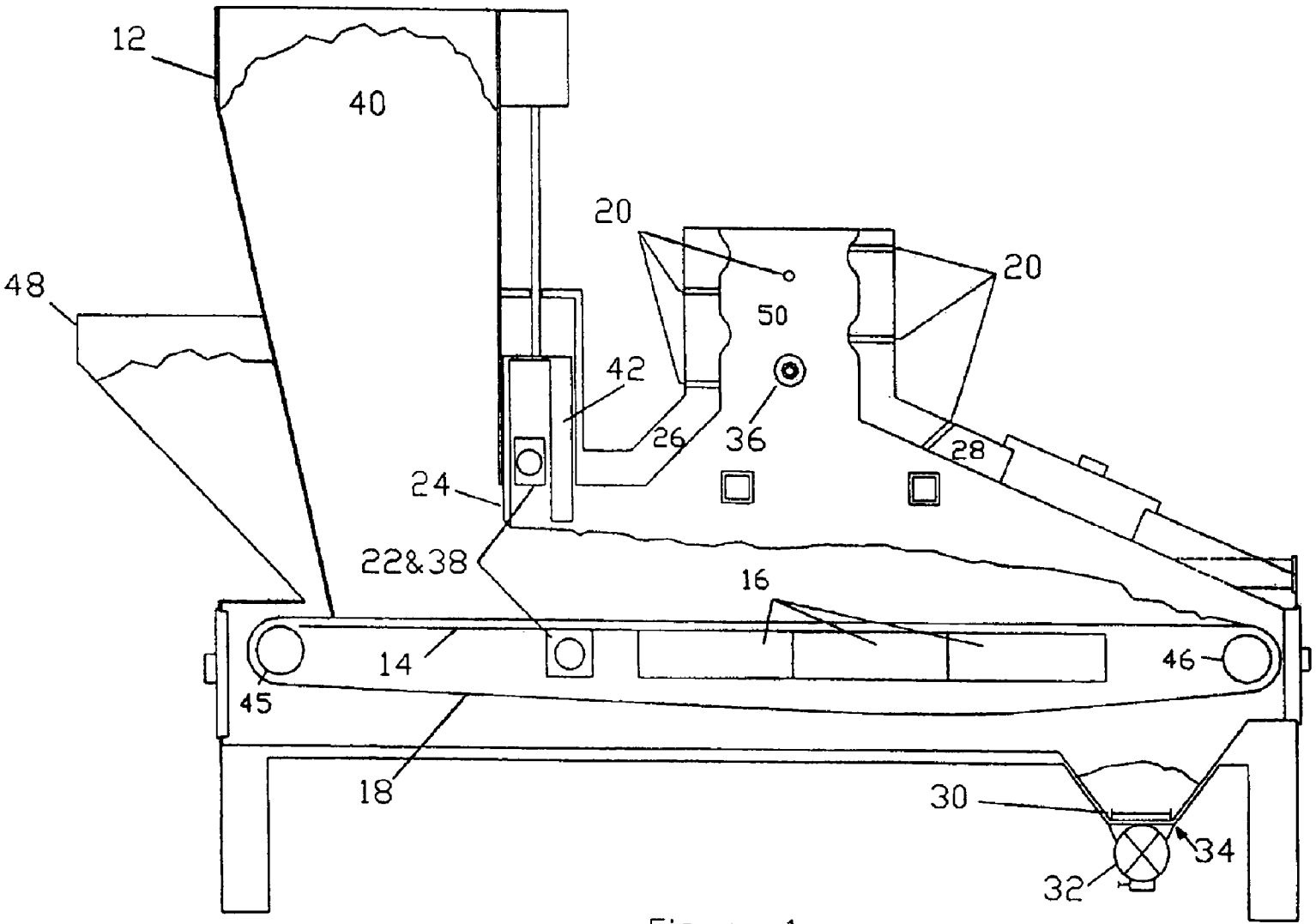
FIG. 1 is a cutaway side view of the apparatus according to the invention.

The apparatus and process described herein uses organic waste fuel such as animal waste, human waste, poultry litter, biomass (organic matter available on a renewable basis such as forest and mill residues, agricultural crops and wastes, wood and wood wastes, animal wastes, livestock operation residues, aquatic plants, fast-growing trees and plants, and municipal and industrial wastes), or combinations thereof as a fuel to produce steam for electricity generation and/or process steam. This use for a generally discarded waste turns what is now considered a liability into a revenue stream.

The apparatus/chamber comprises a hopper 12, a perforated stationary plate 14, multiple controlled air zones 16 located beneath the perforated stationary plate, a moving grate 18, over fire air nozzles 20, and a guillotine level control gate 24, all located in a specifically designed gasification/combustion chamber. The apparatus uses both ignition 26 and burnout arches 28. Additionally, the apparatus may comprise ash removal conveyor 30 that runs perpendicular or parallel to the moving grate (shown as perpendicular in the Figures), combustion retarding oxygen deficient gas entry 22, air lock discharge 32, pilot burner 36, and provision for emission control agent injection 38.

The organic waste fuel 40 is conveyed via a material storage and handling system (not shown) using, for example, a silo with un-loader or fuel building with a walking floor system to a belt and vibratory conveyor system designed specifically for the characteristics of the fuel. The fuel is conveyed into a fuel hopper 12 located at the entrance to the apparatus 10. The fuel feed hopper 12 is located directly above the moving grate 18 which is continuously conveying into the apparatus 10. The high temperature moving grate 18 is an open weave/mesh design, or any other grate that permits air passage through itself (i.e. bars, rods), that allow combustion air to pass through the perforated stationary plate into the fuel bed. The pressure drop across the perforated plate must be significant relative to the pressure drop through the fuel bed. Controlling the pressure drop through the perforated stationary plate ensures uniform distribution of combustion air despite quantity, moisture and bulk density variability within the fuel bed.

The moving grate 18 pulls the fuel 40 into the combustion chamber. The moving grate 18 is rotating on a system of roller assemblies 45 and 46 located at each end of and/or throughout the combustion unit 10. The moving grate 18 and roller assembly is a positive drive design. A sprocket and chain combination, a cleated/studded roller and matched grate, a tension roller, a counter weight roller system, a pinch roller system, or any other method of pulling or pushing the moving grate provide the drive for the moving grate 18 and fuel bed. The moving grate preferably moves at a rate of 20 feet per hour.

Figure 2:
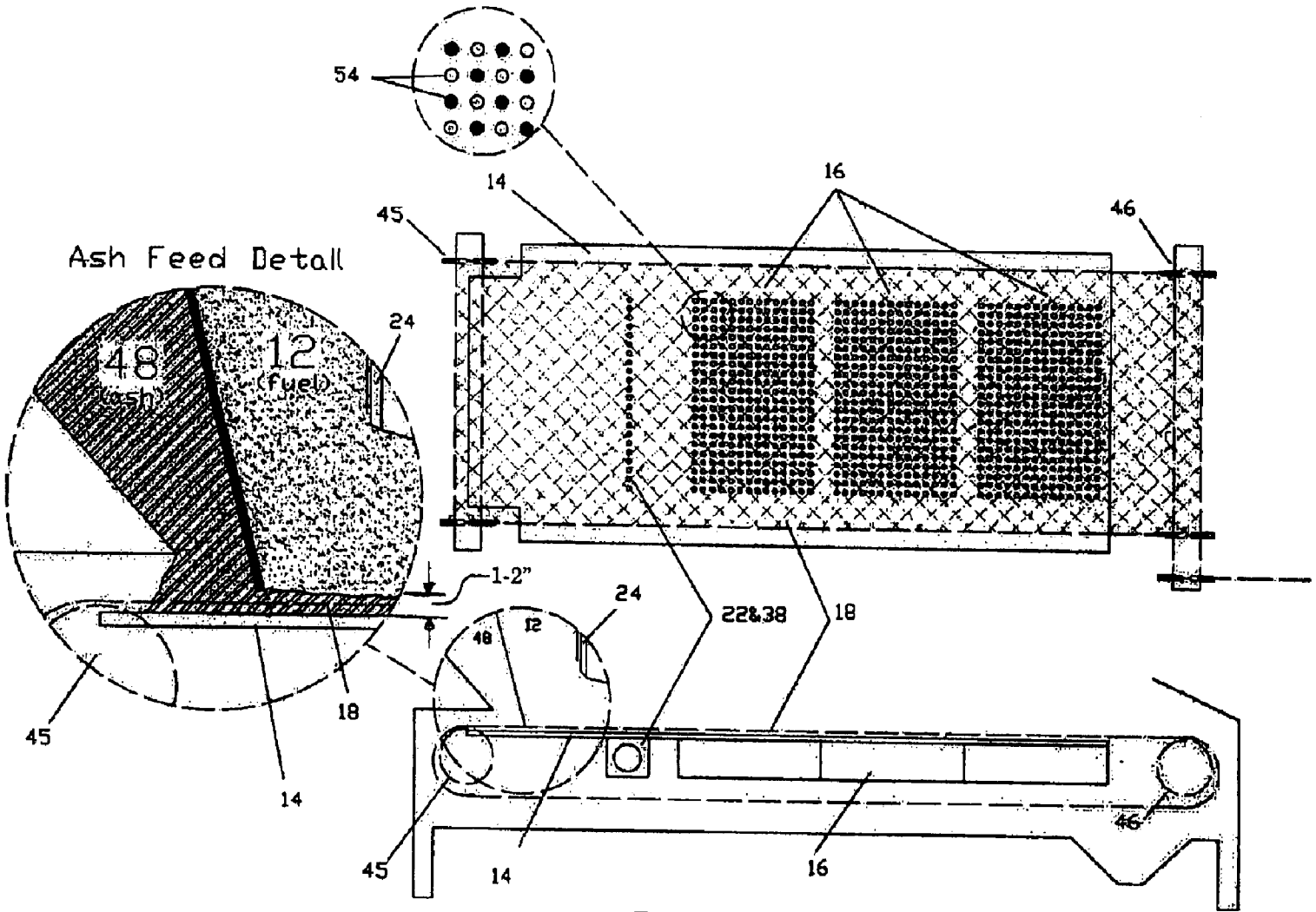
FIG. 2 is an enlarged detail of the throat and guillotine gate assemblies shown in FIG. 1.
Figure 3:
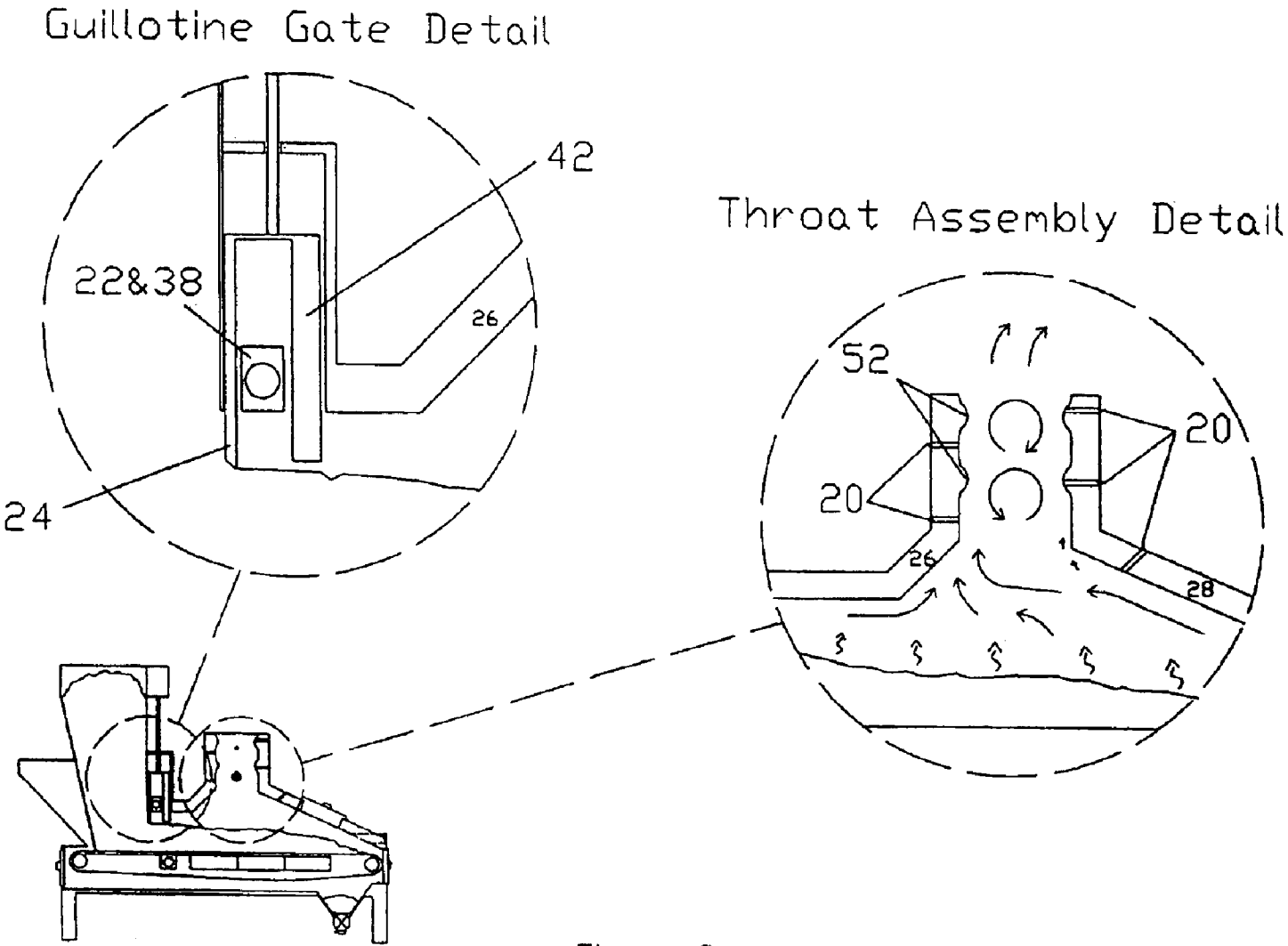
FIG. 3 is a drawing of the perforated stationary plate and enlarged detail of the ash reintroduction and feed assembly.

The fuel 40 on the moving grate moves through a guillotine level control gate 24. The guillotine gate assembly is adjustable and used to control the bed depth of the fuel (as seen in FIG. 2, guillotine gate assembly detail where the fuel depth is high on the left side of the guillotine gate and lower on the right side of the same gate). A protective insulating panel 42 is attached in front of the guillotine gate to protect it from the high temperatures of combustion. The area between the guillotine feed gate and the protective insulating panel is where the upper combustion retarding gas 22 and emission control injection unit 38 is located.

The drive roller assembly at the ash ends of the combustion unit is driven by a variable speed motor (not shown). The variable speed drive allows for speed control of the moving grate 18 and therefore the fuel input to the unit and the load on the heat exchanger unit.

Oxygen deficient gas (flue gas) is introduced at the combustion chamber entrance adjacent to guillotine gate 24 to prevent the fuel from combusting back into the fuel feed hopper. Flue gas from the stack (not shown) is piped to two locations 22, just as the fuel enters the combustion chamber. The first location 22, underneath the stationary plate, forces the flue gas up through the fuel bed just after it has left the hopper 12. The second location 22 is alongside the guillotine gate 24 on the combustion chamber side above the fuel bed. This fills the void left in the ignition arch 26 above the fuel bed with a non-combustion promoting gas when the guillotine gate 24 is not fully open. This prevents dangerous combustion directly adjacent to the fuel feed hopper 12 and prevents combustion from propagating back into the fuel source.

The same location where the combustion retarding gas is introduced at the guillotine gate provides an ideal place to introduce emission control agents to the fuel bed. Common emission control agents are urea, ammonia, and limestone.

The moving grate 18 is pulled across the perforated stationary plate 14 inside the combustion chamber 10. The perforated stationary plate 14 is sectioned into separate and discreet controllable air zones or chambers 16. Each zone is air fed by a force draft fan (or fans, not shown) and are located beneath the perforated stationary plate and begin just after the combustion retarding oxygen deficient gas entry area. The zones extend the length of the combustion chamber and end just before the ash collection chamber. The number of controllable zones is determined by the capacity of the unit and the fuel characteristics. For example wetter fuels will require different settings than dry fuel. The initial zones dry the fuel, drive off volatiles and ammonia gas, gasification is continued in subsequent zones under conditions suited for the dry fuel source and reduced bed depth. The final zone is designed to complete the consumption of all remaining combustibles producing a desirable ash product.

The first zone begins directly after the lower oxygen deficient gas 22 is introduced at the entrance to the combustion chamber. The perforations 54 in the stationary plate 14 are holes and/or slots that are sized, shaped and oriented to provide proper air distribution and pressure drop through the stationary plate. The pressure drop through the plate is critical to providing air to all sections of the fuel bed even as the bed characteristics change in the combustion process. The specific combination, orientation and location of holes and/or slots in the perforated plate are determined by the characteristics of the fuel in that section of the bed. For example, the wet fuel entering the first combustion zone will require a different amount of air and air pressure than the dry fuel in the subsequent zones. The orientation and location of the holes reflect these changing requirements. In one embodiment, the perforations 54 can be closed (shown darkened in FIG. 2) or open and thus restrict or promote air that passes to the organic waste fuel on the moving grate.

Controlled temperature combustion air is directed into the first under fire air zone and controlled through a valve or variable speed fan for proper pressure drop through the grate under varying fuel load conditions. The first zone introduces the fuel bed to controlled temperature combustion air initiating gasification and driving the combustion process. The moving grate 18 continues to pull the fuel bed further into the combustion chamber 10 towards the ash removal end over the remaining zones. As in the first zone, each under fire air zone is controlled through its own valve or variable speed fan to allow for complete regulation of controlled temperature under fire air as the combustion process progresses through the unit.

Adjacent to the fuel feed hopper 12 is an ash feed hopper 48. Ash is recycled from the ash collection system 34 and reintroduced onto the moving grate 18 below the fuel 40. As clearly seen in the Ash Feed Detail of FIG. 2, a layer of ash 48, or waste fuel-byproduct, located between the waste fuel 40 and the moving grate 18, is preferably 1–2 inches thick and protects the moving grate 18 and stationary perforated plate from the high temperatures in the combustion chamber 10. This layer extends the longevity and reliability of the unit.

The combustion unit 10 itself is fabricated with industry standard materials, construction techniques and practices and controls systems. For example, carbon steel is used for the external walls of the gasifying chamber apparatus. Industry standard welding and bolt assembly practices are used to fabricate the shell. Select grades of stainless steel are required within the apparatus to withstand areas of high temperature and high wear due to the properties of the ash. Specific types of refractory designed for high potassium environments are used. Other industrial grade materials like insulation, gasketing and high temperature paints are used.

Several design considerations for the size and location of the described elements are preferable. The combustion chamber 10 begins with an ignition arch 26 extending between two to six feet, into the combustion chamber and across the entire width of the unit. The ignition arch 26 is designed to be close to the top of the fuel bed in order to radiate heat back down into the fuel bed. This additional heat promotes driving off moisture and prepares the fuel to be gasified. In cases where the fuel contains ammonia, the intensity of the heat below the ignition arch promotes the release of ammonia gas from the fuel bed. The angle of the ignition arch 26 directs the ammonia gas into the throat of the combustion chamber where it mixes with the combustion gases and reduces the production of nitrous oxides (NOx) in the flue gas emissions.

The design of the ignition arch 26 and the combustion apparatus 10 uses the constituents of the fuel to self scrub the flue gas. As the fuel bed is leaving the ignition arch 26 it reaches the first zone of perforations in the stationary plate. This provides the combustion air necessary to start the gasification process. The oxygen in the under fire air from the controllable air zones 16 reacts with the fuel as it passes through the bed and begins to form the combustible gases to be burned. These combustion reactions continue as the fuel progresses successively along the stationary perforated plate with each zone providing the necessary quantity of combustion air for successful combustion. As the fuel moves towards the end of the plate, the burnout arch 28 provides additional intense burn by reflecting heat back into the combusting fuel. The over fire air nozzles intensify this burn as well by driving the gas by-products towards the throat 50. Once the fuel reaches the end of the plate, all combustibles have been released and ash is carried out of the combustion chamber 10.

The combustible gases rise out of the fuel 40 into the combustion chamber above the bed. Controlled temperature over fire combustion air is forced through nozzles 20 by the same or a different force draft fan as supplies air to the air zones 16 to provide the necessary oxygen for ignition. The over fire air nozzles 20 are controlled individually with valves just like the under fire air zones and thus have the capability to balance the overall combustion air in the chamber. In addition to being able to balance the quantity of combustion air to coincide with the under fire air supply, air velocity and mixing control are requisites for the over fire air system. Nozzle configuration and placement are designed to provide the retention time and turbulence necessary for proper combustion of gases, emission compliance and particulate reduction. Small particulate lift-off, even with a quiet fuel bed is inevitable. The design of the over fire air system will produce a large amount of recirculation, thereby entraining the fine particulate in the burning gases above the bed to complete combustion. The quantity, direction and speed of the over fire air will be controlled to optimize heat release during the final stages of combustion. Unit performance; i.e. energy output, unit efficiency and emissions are greatly affected by the completeness of combustion.

The top section of the chamber 10 is an inverted funnel or cone shape with the largest dimensions equal to the grate size narrowing as it approaches the throat 50 of the combustion chamber 10. The over fire air nozzles 20 are strategically located throughout the ceiling of the combustion chamber and throughout the throat 50. This design sweeps the hot combustion gases toward the throat where ammonia release is concentrated. In addition to entraining the fine particulate in the burning gases above the bed, this allows for the mixing of combustion gases with ammonia and therefore a reduction in NOx. As seen in FIG. 2, the throat walls are corrugated 52 to enhance mixing and turbulence for combustion and to introduce ignition points (high temperature locations created by the corrugation that encourage a final ignition) used to propagate and help ensure complete combustion throughout the passageway. Once the combustible gases exit the throat 50, completed combustion occurs in the entrance to the heat exchanger unit where the heat is converted to a usable media (steam, hot water, air or other thermal fluid).

The pilot burner 36 is preferably a natural gas burner that burns and reignites any remaining combustible gases in the throat before their release. The pilot burner can also provide additional heat capacity for running the boiler if the heat output from the waste combustion temporarily drops.

A conventional heat recovery unit (i.e. boiler, air heater or similar—not shown) placed over the combustion chamber converts the heat from the combustion process into a usable product. A boiler produces steam for process purposes and/or to generate electricity.

Certain combustion enhancing (or even reducing) agents may be mixed with the organic waste fuel to increase combustion, although for the process described herein, such agents are not necessary. Such combustion enhancing or reducing agents could include Dissolved Air Floatation D.A.F. or waste activated sludge, the combustion of which could improve on current disposal methods for these products.

The apparatus described herein preferably burns at temperatures between 800 and 2,000 degrees Fahrenheit. Cooler burning temperatures are preferable for burning some agricultural wastes that contain higher portions of silica. It has been found that burning such agricultural wastes at high temperatures generates hazardous carcinogens and silicate rocks that could damage the apparatus.

The waste product to energy process described herein is fueled by the waste product itself. The apparatus that converts the waste product into usable energy preferably handles animal waste up to 40% moisture and biomass up to 50% moisture without any fuel conditioning necessary. Poultry manure or litter (manure with bedding, usually woodchips or rice hulls) is generally below 40% moisture coming directly from a farm. Cow or swine manure (up to 97% moisture from the farm) needs to be dried, preferably with bio-drying techniques such as wind rowing.

What is claimed is:

1. An apparatus for converting organic waste fuel into usable energy comprising:

a organic waste fuel loading area for loading organic waste fuel onto a moving grate that moves the organic waste fuel product through the apparatus from the organic waste fuel loading area to an unloading area;

a level control device for controlling the amount of organic waste fuel that moves from the loading area to the moving grate;

a perforated stationary plate located beneath the moving grate with the organic waste fuel thereon that allows air to pass through perforations to the organic waste fuel on the moving grate;

at least one controlled combustion air zone that directs air with a substantially controlled temperature through the stationary plate to the organic waste fuel on the moving grate;

at least one nozzle that directs air above the organic waste fuel on the moving grate;

an ignition source that reacts with the organic waste fuel on the moving grate and the air to combust the organic waste fuel and create at least one organic waste fuel-byproduct; and an organic waste fuel-byproduct loading area for loading organic waste fuel-byproduct onto the moving grate between the organic waste fuel on the moving grate and the moving grate, wherein the organic waste fuel-byproduct between the organic waste fuel on the moving grate and the moving grate is about 1–2 inches thick.

2. The apparatus of claim 1 wherein the organic waste fuel-byproduct between the organic waste fuel on the moving grate and the moving grate is ash.

3. The apparatus of claim 1 further comprising an opening that directs a combustion retarding gas to a location within the apparatus near the organic waste fuel loading area and the moving grate.

4. The apparatus of claim 3 wherein the combustion retarding gas is one of the at least one organic waste fuel-byproduct.

5. The apparatus of claim 3 further comprising a second opening that directs the combustion retarding gas through the perforated stationary plate and the moving grate into the organic waste fuel on the moving grate.

6. The apparatus of claim 1 further comprising an opening that directs emission reducing agents to a location within the apparatus near the organic waste fuel loading area and the moving grate.

7. The apparatus of claim 1 further comprising a force draft fan that supplies the air to the at least one controlled combustion air zone.

8. The apparatus of claim 7 wherein the amount of air supplied to the at least one controlled combustion air zone is determined based on a physical or chemical properties of the organic waste fuel.

9. The apparatus of claim 1 wherein the perforations in the perforated stationary plate can be closed or open and thus restrict or promote air that passes to the organic waste fuel on the moving grate.

10. The apparatus of claim 1 further comprising an ignition arch that radiates heat given off by the combusting organic waste fuel back into the combusting organic waste fuel.

11. The apparatus of claim 10 wherein at least one of the organic waste fuel-byproducts is ammonia gas; and wherein the ignition arch is at an angle that directs the ammonia gas into a throat of the combustion chamber.

12. The apparatus of claim 1 further comprising a throat that collects and mixes ammonia gas that is at least one of the organic waste fuel-byproducts with other gases that are at least one of the organic waste fuel-byproducts.

13. The apparatus of claim 12 wherein the throat has a corrugated shape.

14. The apparatus of claim 13 wherein the corrugated shape of the throat creates ignition points that combust organic waste fuel-byproducts in the throat.

15. The apparatus of claim 1 wherein the moving grate allows air to pass through.

16. The apparatus of claim 1 wherein the level control device is an adjustable gate that is adjustable in a direction perpendicular to a direction that the moving grate moves.

17. The apparatus of claim 16 wherein a protective insulating panel protects the adjustable gate from heat-related damage.

18. The apparatus of claim 1 wherein the moving grate is mounted on a roller assembly that drives the moving grate.

19. The apparatus of claim 1 wherein one of the at least one organic waste fuel by-products is an ash suitable for use as a fertilizer.

20. The apparatus of claim 1 wherein one of the at least one organic waste fuel by-products is an ash suitable for use as a feed additive.

21. The apparatus of claim 1 wherein one of the at least one organic waste fuel by-products is an ash suitable for use as a mineral supplement.

22. The apparatus of claim 1 further comprising a variable speed force draft fan that supplies air to the at least one controlled combustion air zone.

23. The apparatus of claim 1 further comprising a variable speed force draft fan that supplies air to the at least one nozzle.

24. The apparatus of claim 1 further comprising combustion-enhancing agent that is added to the organic waste fuel to increase the combustion of the organic waste fuel.

25. The apparatus of claim 1 further comprising combustion-reducing agent that is added to the organic waste fuel to decrease the combustion of the organic waste fuel.

26. The apparatus of claim 1 further comprising a burnout arch that intensifies combustion of the organic waste fuel on the moving grate.

27. The apparatus of claim 1 further comprising a pilot burner that ignites flammable organic waste fuel-byproducts before the organic waste fuel-byproducts exit the apparatus.

28. An apparatus for converting organic waste fuel into usable energy comprising:

a organic waste fuel loading area for loading organic waste fuel onto a moving grate that moves the organic waste fuel product through the apparatus from the organic waste fuel loading area to an unloading area;

a level control device for controlling the amount of organic waste fuel that moves from the loading area to the moving grate;

a perforated stationary plate located beneath the moving grate with the organic waste fuel thereon that allows air to pass through perforations to the organic waste fuel on the moving grate, wherein the perforations in the perforated stationary plate can be closed or open and thus restrict or promote air that passes to the organic waste fuel on the moving grate;

at least one controlled combustion air zone that directs air with a substantially controlled temperature through the stationary plate to the organic waste fuel on the moving grate;

at least one nozzle that directs air above the organic waste fuel on the moving grate;

an ignition source that reacts with the organic waste fuel on the moving grate and the air to combust the organic waste fuel and create at least one organic waste fuel-byproduct.

* * * * *